US011381024B2

(12) United States Patent
Xu et al.

(10) Patent No.: US 11,381,024 B2
(45) Date of Patent: Jul. 5, 2022

(54) ELECTRICAL CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: De-Ming Xu, Kunshan (CN); Xiao-Bo Du, Kunshan (CN); Guo-Hua Zhang, Kunshan (CN); Zi-Qiang Zhu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/186,000

(22) Filed: Feb. 26, 2021

(65) Prior Publication Data

US 2021/0265760 A1 Aug. 26, 2021

(30) Foreign Application Priority Data

Feb. 26, 2020 (CN) ..... 202010120123.4

(51) Int. Cl.
*H01R 13/405* (2006.01)
*H01R 43/20* (2006.01)
*H01R 43/00* (2006.01)

(52) U.S. Cl.
CPC ..... *H01R 13/405* (2013.01); *H01R 43/005* (2013.01); *H01R 43/20* (2013.01)

(58) Field of Classification Search
CPC ..... H01R 13/405; H01R 43/005; H01R 43/20
USPC ..... 439/936
See application file for complete search history.

(56) References Cited

U.S. PATENT DOCUMENTS 3,721,948 A * 3/1973 Brandt ..... H01B 17/305 439/736
4,335,932 A * 6/1982 Herrmann, Jr. ..... H01R 43/24 174/541
4,662,692 A * 5/1987 Uken ..... H01R 13/5216 439/271
4,826,451 A * 5/1989 Cunningham ..... H01R 13/533 439/589
5,637,007 A * 6/1997 Suzuki ..... H01R 13/5216 439/936

(Continued)

FOREIGN PATENT DOCUMENTS

CN 203553471 U 4/2014
CN 205122851 U 3/2016

(Continued)

*Primary Examiner* — Neil Abrams
(74) *Attorney, Agent, or Firm* — Ming Chieh Chang; Wei Te Chung

(57) ABSTRACT

An electrical connector includes an insulative housing and a plurality of contacts retained thereto. Each contact includes a retaining section, a contacting section in front of the retaining section, and a mounting section behind the retaining section. A plurality of independent glue reservoirs are formed on a rear side of the housing via crossing partitions. A tiny passage is formed in an exterior face of the partition to communicate the neighboring glue reservoirs so as to assure the even/same height of the hardened glue blocks in respective glue reservoirs.

8 Claims, 10 Drawing Sheets

(56) References Cited

U.S. PATENT DOCUMENTS 5,658,170 A * 8/1997 Tan ..... H01R 13/65914 439/607.41
6,132,251 A * 10/2000 Onoda ..... H01R 13/5216 439/587
6,149,456 A * 11/2000 Uchiyama ..... H01R 13/521 439/948
6,619,830 B2 * 9/2003 Nagakura ..... B60Q 1/0088 362/546
6,866,552 B2 3/2005 Koehler
7,238,036 B2 * 7/2007 Sato ..... H01R 13/5216 439/236
7,413,445 B2 * 8/2008 Inagaki ..... B60R 16/0239 439/936
7,445,481 B2 * 11/2008 Nagashima ..... H01R 13/521 439/936
7,874,850 B2 1/2011 Yamagami et al.
8,814,606 B2 * 8/2014 Endo ..... H01R 43/18 439/930
9,017,088 B2 * 4/2015 Endo ..... H01R 9/00 439/276
9,033,747 B2 * 5/2015 Sato ..... H01R 13/521 439/736
9,331,421 B2 * 5/2016 Lai ..... H01R 13/5202
9,397,431 B2 * 7/2016 Hirayama ..... G01L 19/0084
9,478,893 B2 * 10/2016 Endo ..... H01R 13/50
9,570,825 B2 * 2/2017 Ozaki ..... H01R 12/716
9,608,359 B2 * 3/2017 Arai ..... H01R 13/5202
9,847,595 B2 * 12/2017 Tsai ..... H01R 24/60
9,871,317 B2 * 1/2018 Zhang ..... H01R 13/648
9,876,303 B2 1/2018 Suemitsu
10,381,773 B2 * 8/2019 Hashimoto ..... H01R 43/005
10,931,046 B2 * 2/2021 Komori ..... H01R 12/716
11,114,791 B1 * 9/2021 Lee ..... H01R 4/70

FOREIGN PATENT DOCUMENTS

CN 206370536 U 8/2017
CN 209387957 U 9/2019

* cited by examiner

ELECTRICAL CONNECTOR

BACKGROUND OF THE INVENTION

1. Field of the Invention

The present invention relates to an electrical connector, and particularly to the electrical connector with hermetic structures thereof for enhancing waterproofing.

2. Description of Related Arts

China Utility Patent CN205122851U discloses an electrical connector with a plurality of independent relatively small reservoirs, which is an improvement to the traditional one having a single relatively huge space without the partition therein and tending to result in an uneven distribution of the injected glue. Notably, the small sized independent rooms for receiving and maintaining the glue may be beneficial for smooth fluidity of the glue while tending to have different depths of the injected glue in the respective independent rooms. Therefore, the waterproofing function at different rooms may not be equal with differences, disadvantageously.

Therefore, it is desired to provide an electrical connector with an improved hermetic structure wherein the glue may be not only injected into the small sized independent rooms formed on the back side of the housing for receiving the glue under superior fluidity but also distributed evenly with the same height in all the independent rooms for maintaining the same waterproof effect in all respective rooms.

SUMMARY OF THE INVENTION

An electrical connector includes an insulative housing and a plurality of contacts retained thereto. Each contact includes a retaining section, a contacting section in front of the retaining section, and a mounting section behind the retaining section. A plurality of independent glue reservoirs are formed on a rear side of the housing via crossing partitions. A tiny passage is formed in an exterior face of the partition to communicate the neighboring glue reservoirs so as to assure the even/same height of the hardened glue blocks in respective glue reservoirs.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
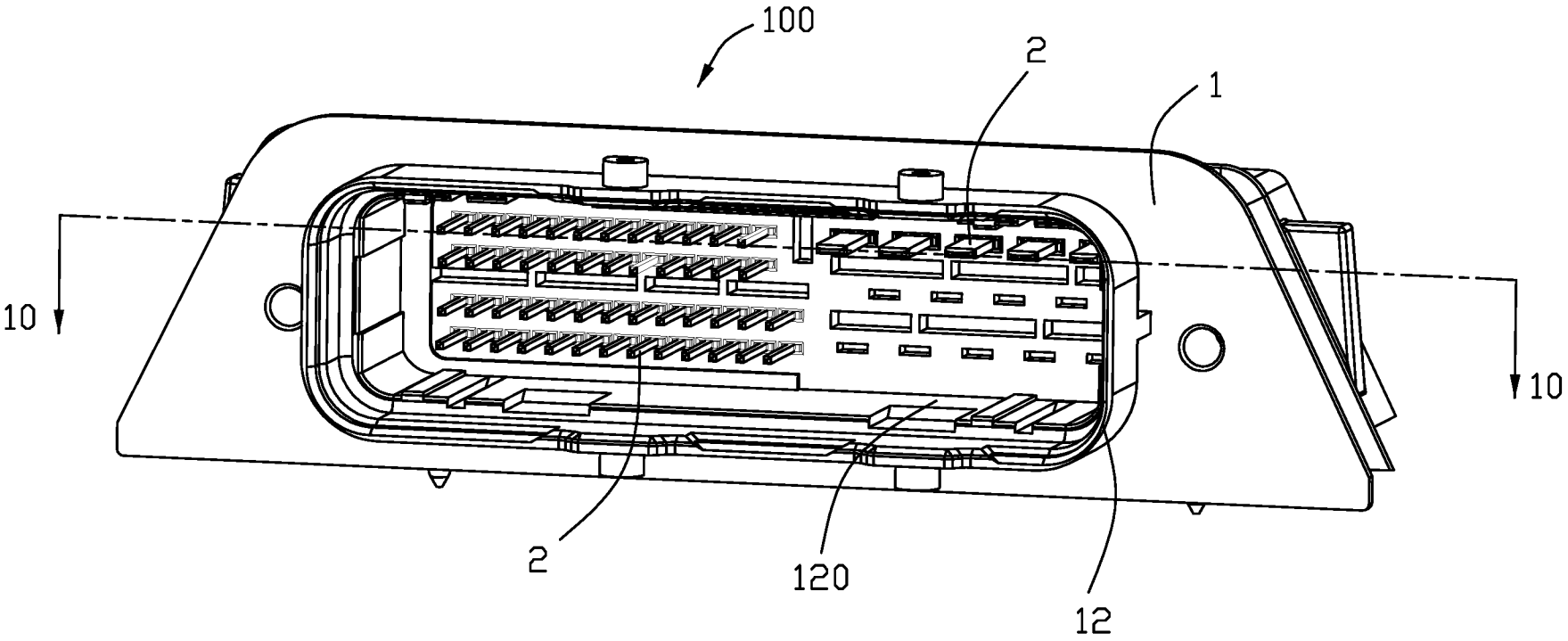
FIG. 1 is a perspective view of an electrical connector according to the invention.
Figure 2:
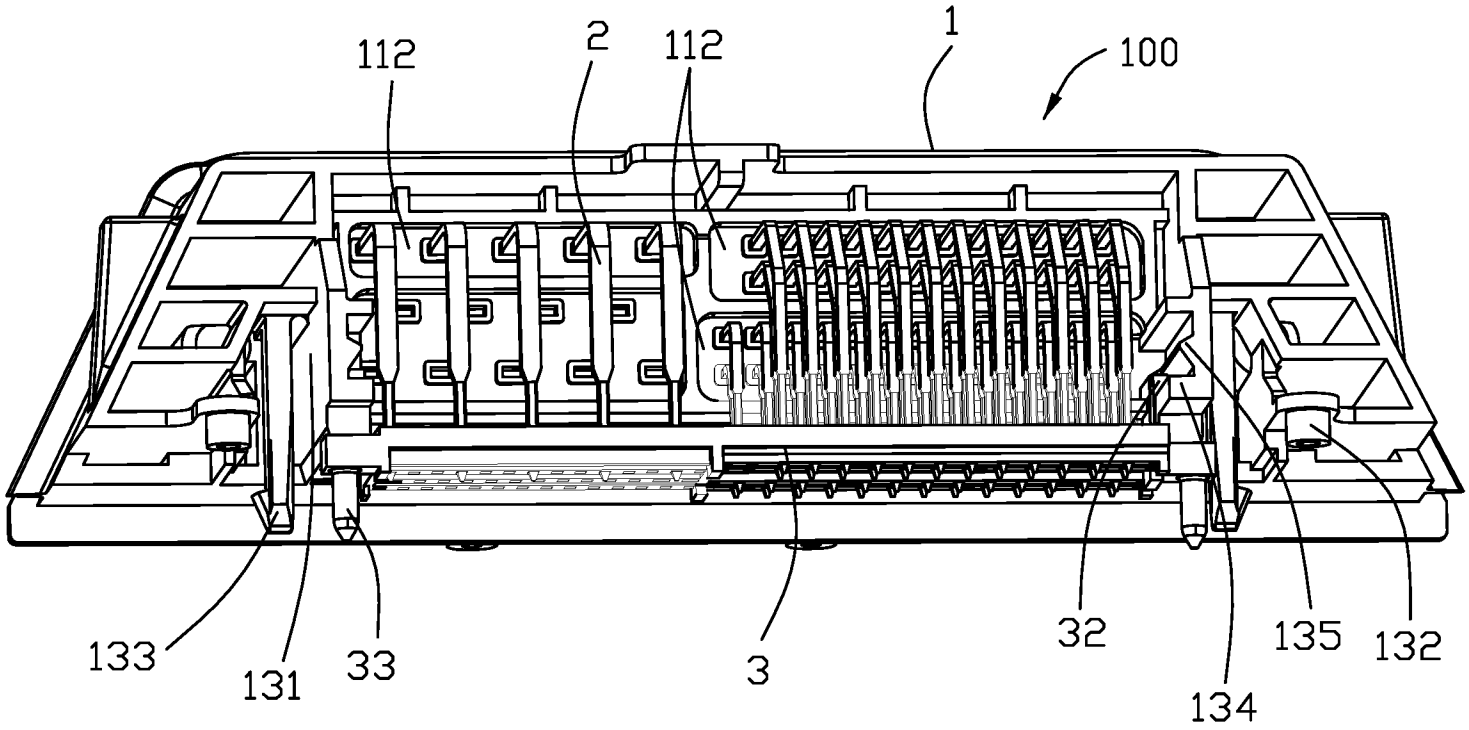
FIG. 2 is another perspective view of the electrical connector of FIG. 1 without showing the hermetic structures on the rear side of the housing.
Figure 3:
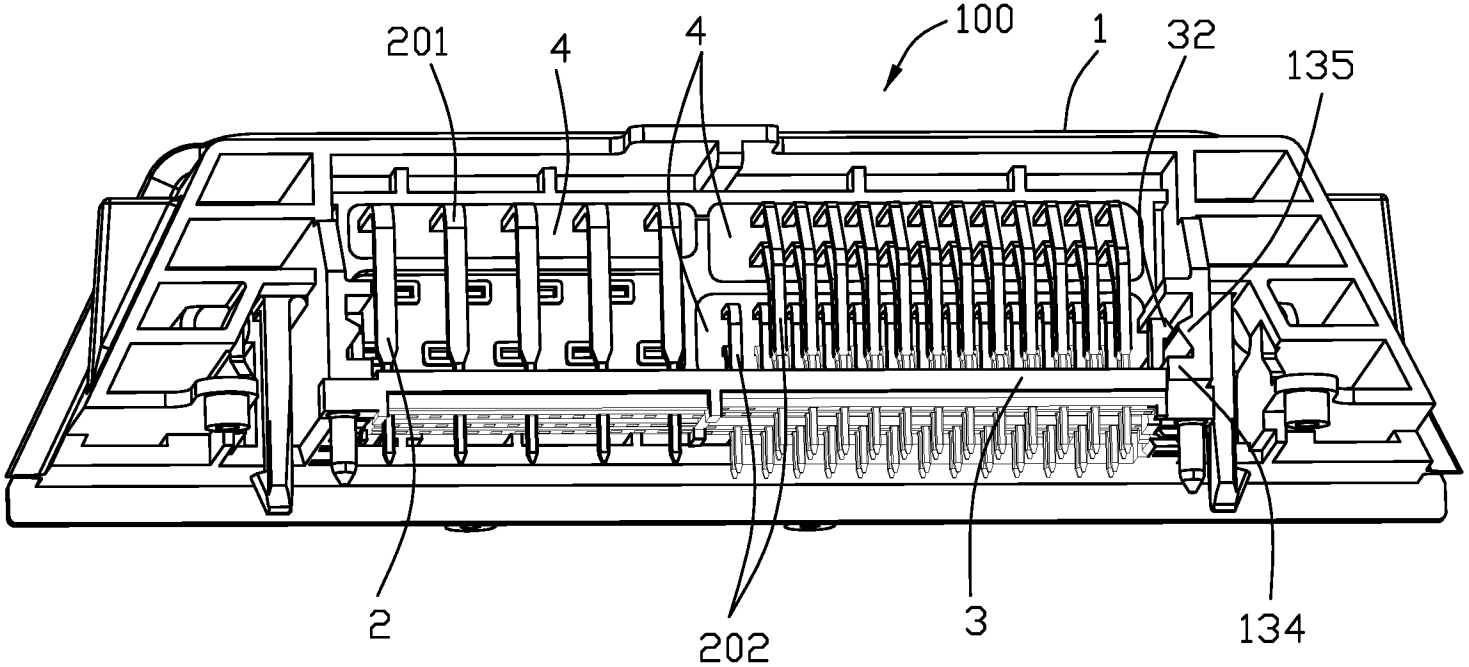
FIG. 3 is a perspective view of the electrical connector of FIG. 1 with the hermetic structures on the rear side of the housing.
Figure 4:
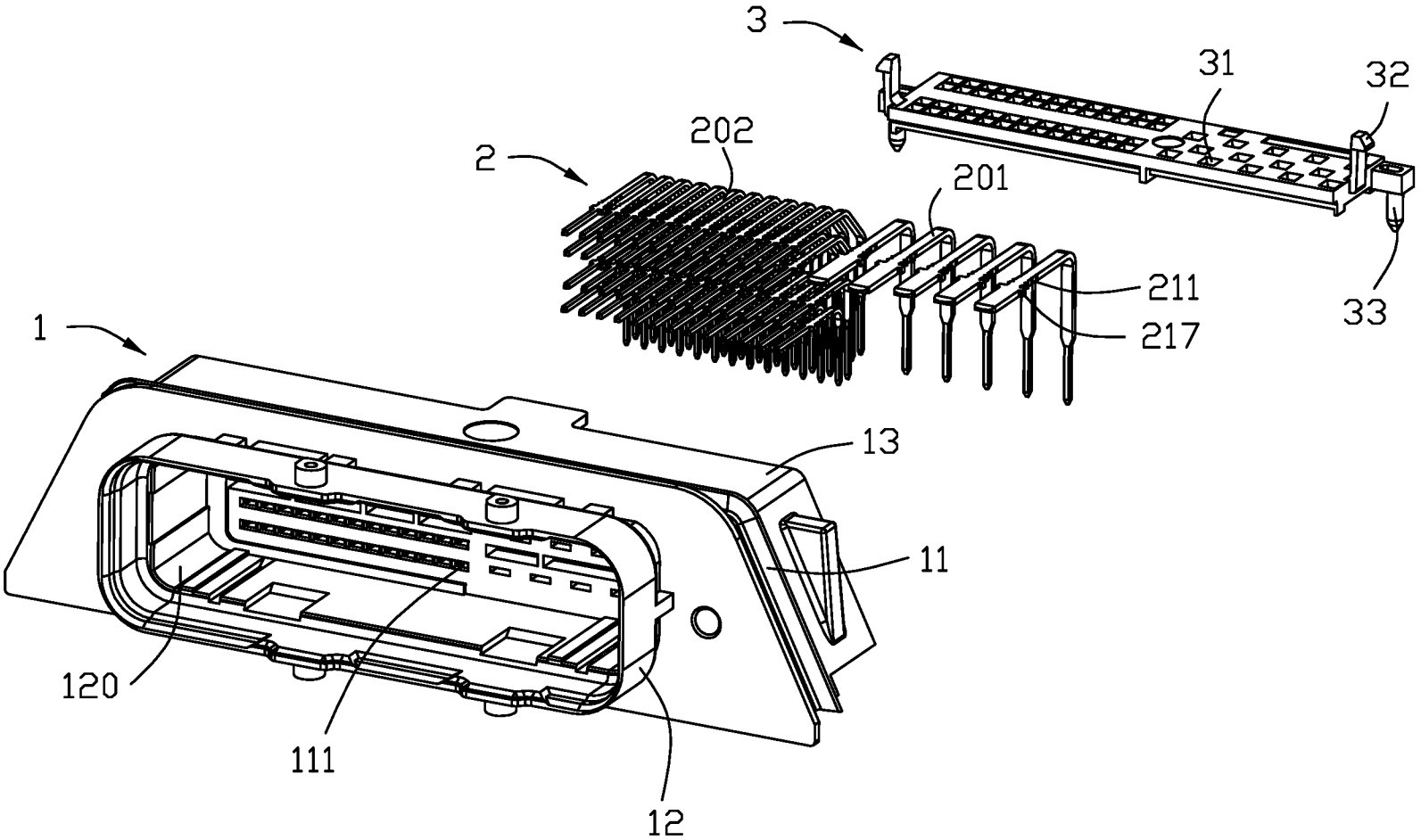
FIG. 4 is an exploded perspective view of the electrical connector of FIG. 3.
Figure 5:
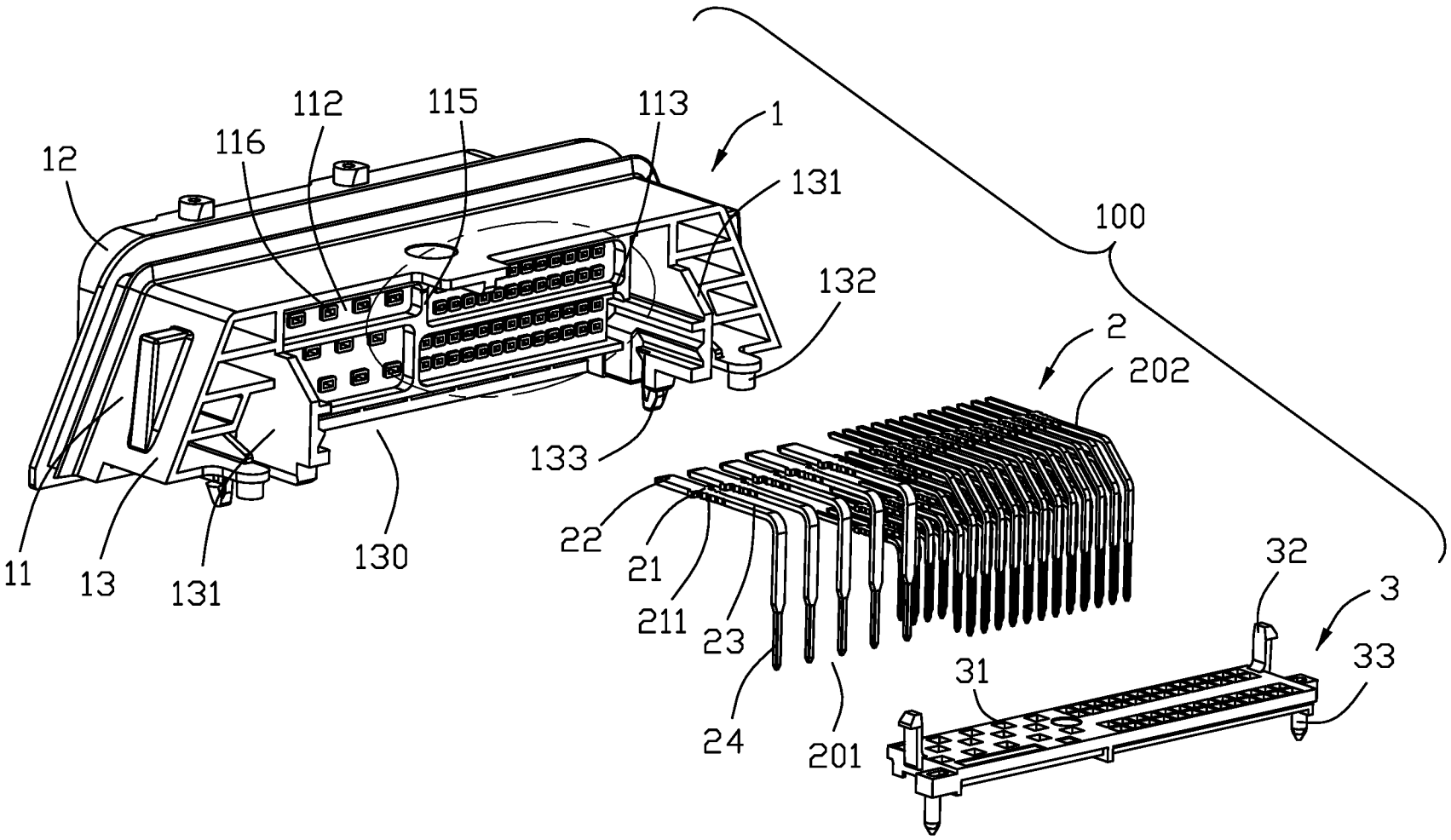
FIG. 5 is another exploded perspective view of the electrical connector of FIG. 4.
Figure 6:
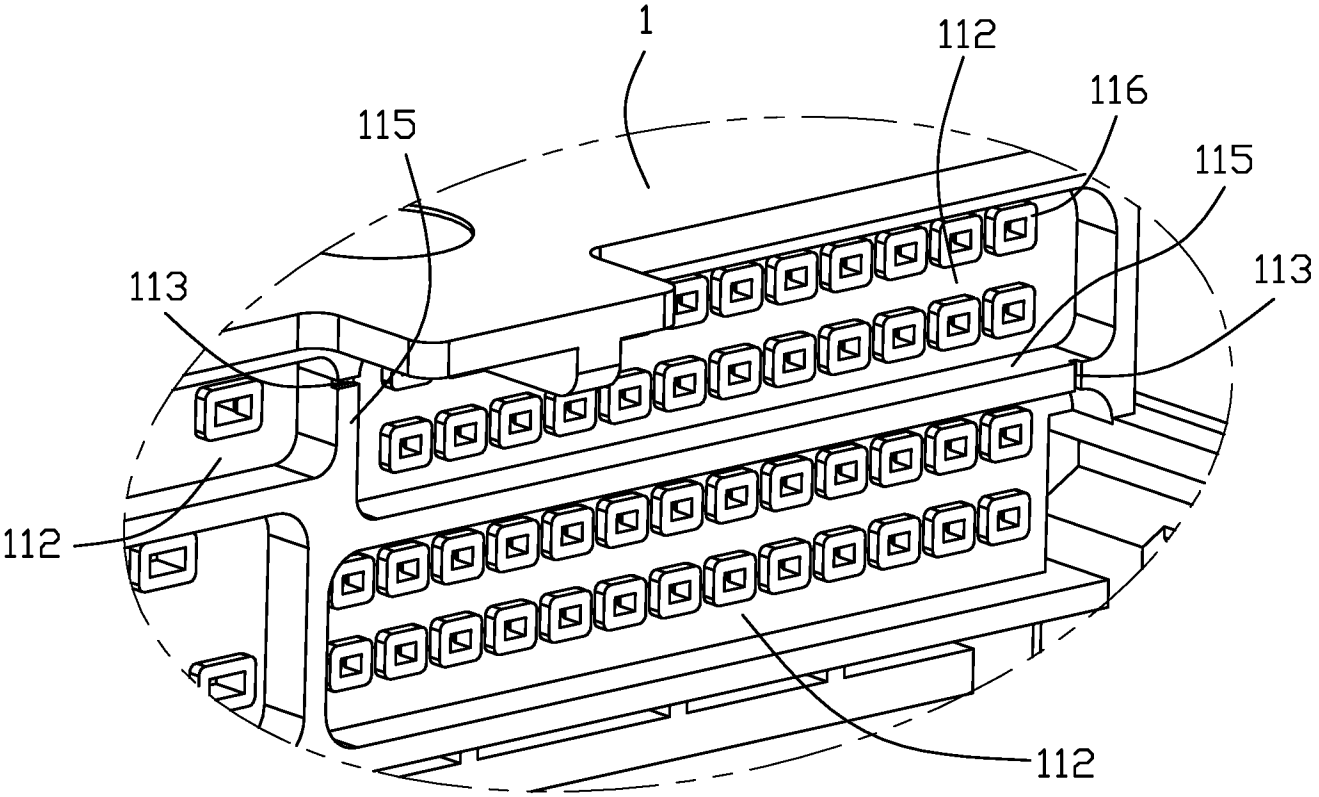
FIG. 6 is an enlarged cross-sectional view of a portion of the electrical connector of FIG. 1.
Figure 7:
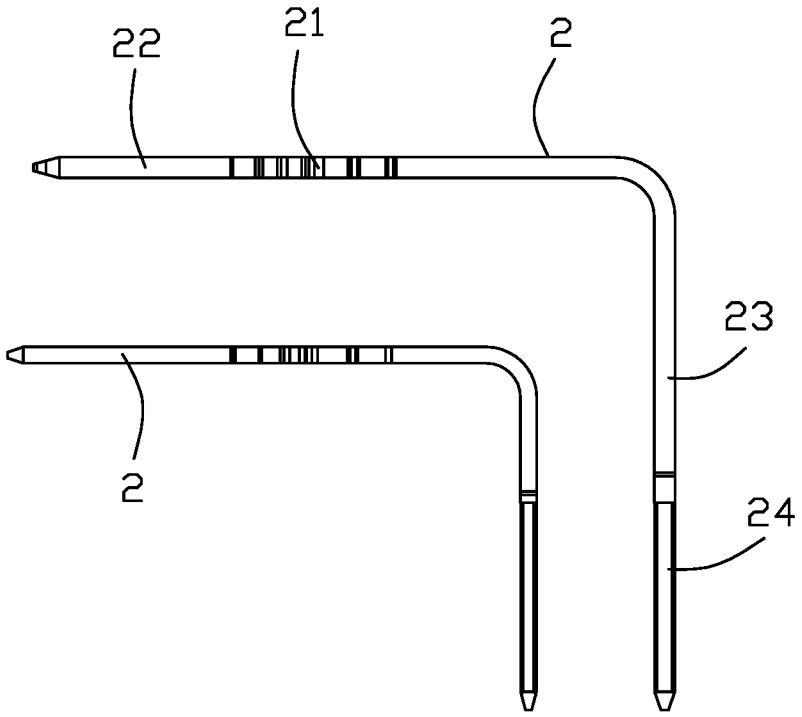
FIG. 7 is a side view of the contacts of the connector of FIG. 1.
Figure 8:
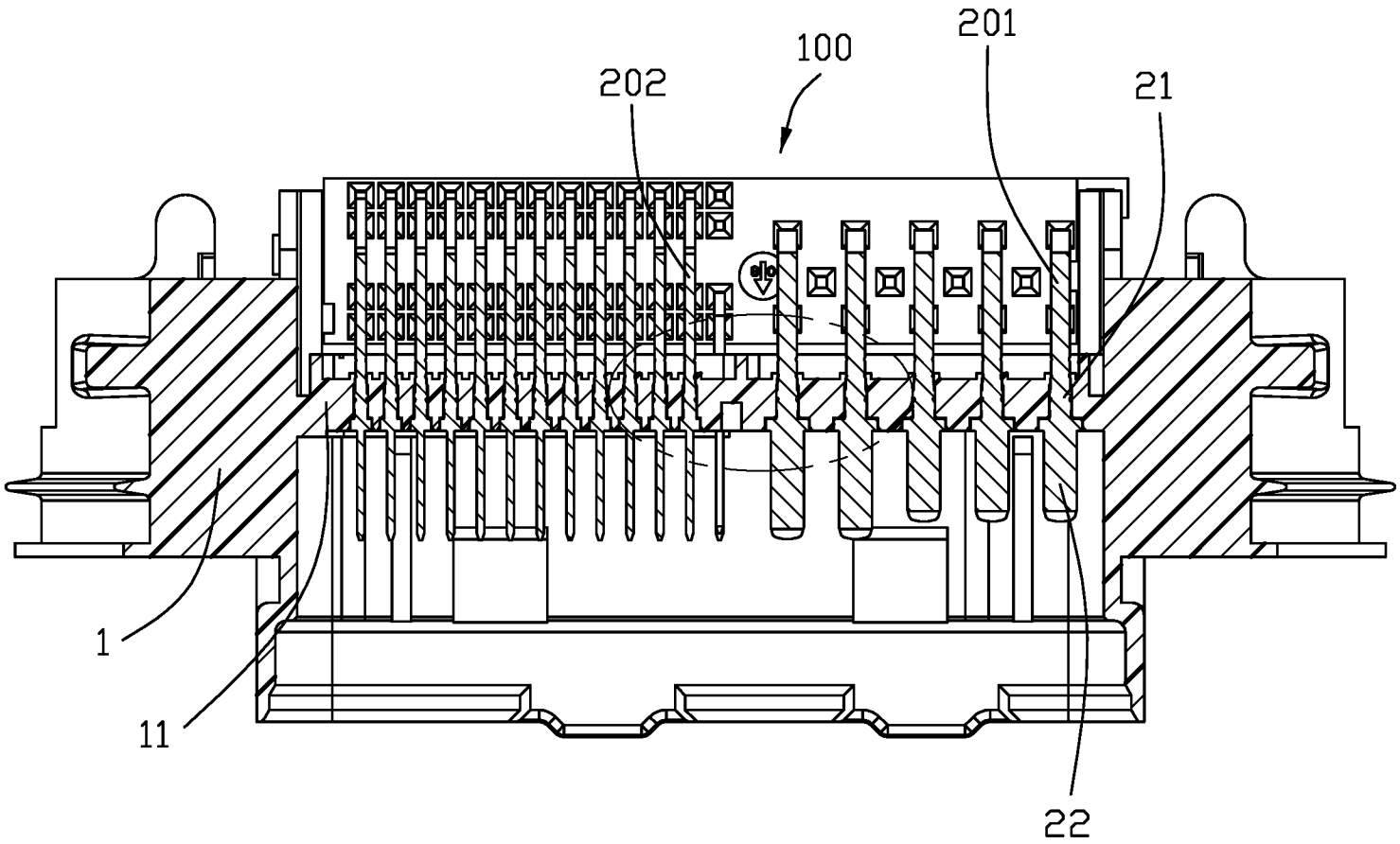
FIG. 8 is a cross-sectional view of the electrical connector of FIG. 1 without showing the hermetic structures.

Referring to FIGS. 1-10, an electrical connector 100 includes an insulative housing 1, a plurality of contacts 2 retained to the housing 1, and a spacer 3. The contacts 2 include a set of power contacts 201 and two sets of signal contacts 201. The contact 2 includes a retaining section 21 retained within the housing 1, a contacting section 22 in front of the retaining section 21, and a mounting section 24 located behind the retaining section 21 with a right angle type connecting section 23 linked therebetween.

The housing 1 includes a base 11, a pocket 12 extending forwardly from the base 11, and a mounting stand 13 behind the base 11. The pocket 12 surrounds a receiving cavity 120 into which the contacting sections 22 extend. A receiving space 130 is formed in the mounting stand 13, and the connecting sections 23 are received within the receiving space 130. The base 11 forms a plurality of passageways 111, and the retaining sections 21 are equipped with barbs 211 to be engaged within the passageways 111. A plurality of glue rooms 112 surrounded by partitions 115, are formed behind the base 11, through which the connecting sections 23 extend. A tiny passage 113 is formed in an exterior face of the partition 115 to communicate the two neighboring glue rooms 112 with each other. It is especially true when the fluid type is injected into the respective glue rooms 112 and can flow toward the neighboring glue room 112 via the passage 113 so as to assure the fluid type glue 4 in the respective glue rooms 112 may keep at a same level with the same depth so as to have the corresponding hardened glue blocks have the same waterproofing effect with regard to the contacts 2. Understandably, the partitions and the glue may be applied upon a front side of the base 11 instead of the rear side thereof.

A standoff 116 is formed on a rear side of the base 11 around the corresponding passageway 111 and extends into the glue room 112. Oppositely, the front side of the base 11 forms a recess 117 in each passageway 111 to receive a corresponding step 217 forms on the contact 2 so as to stabilize the contact 2 in the passageway 111.

The spacer 3 forms a through holes 31 through which the mounting sections 24 of the contacts 2 extend. The mounting stand 13 includes a pair of walls 131 between which the receiving space 130 is formed. Each wall 131 includes a post 132 for extending into the corresponding hole in the printed circuit board on which the connector 100 is seated, and a hook 133 engaged with an undersurface of the printed circuit board. The spacer 3 is assemble upon the housing 1 in a floating manner by means of the locking projections 134, 135, which are formed on the corresponding wall 131, in engagement with the hooks 32 formed on the spacer 3. The spacer 3 further includes a pair of posts 33 extending into the holes in the printed circuit board.

Figure 9:
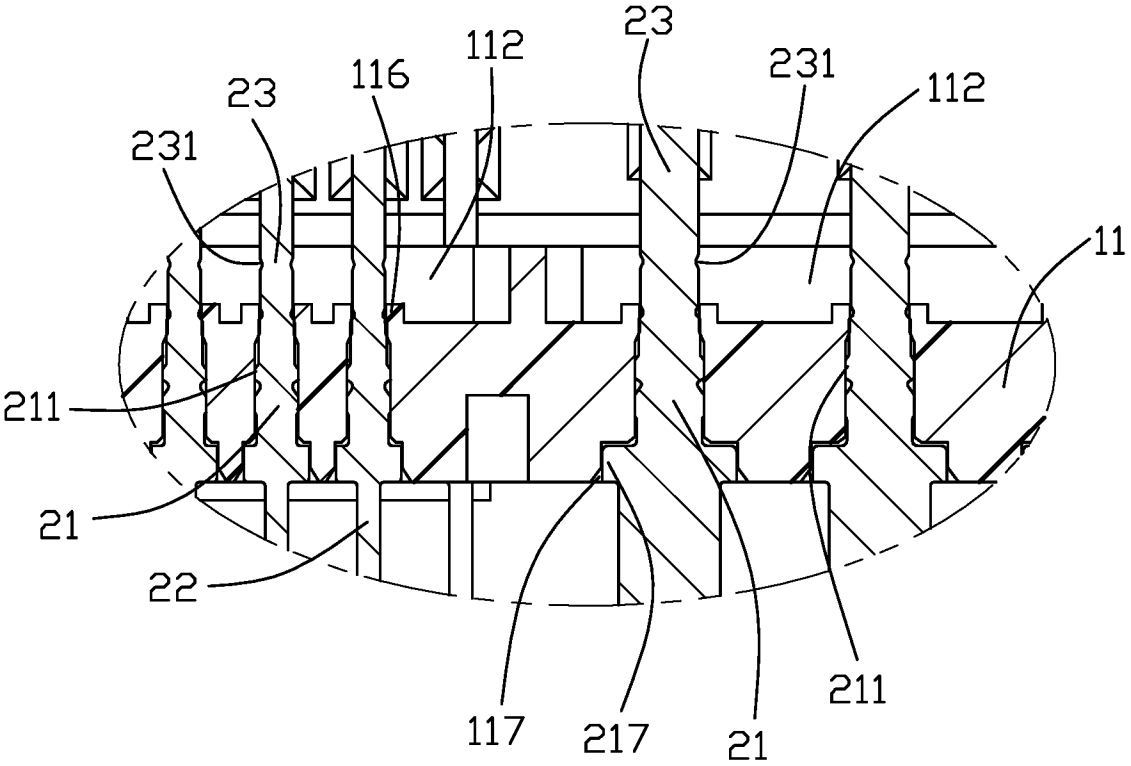
FIG. 9 is an enlarged cross-sectional view of a portion of the electrical connector of FIG. 8.
Figure 10:
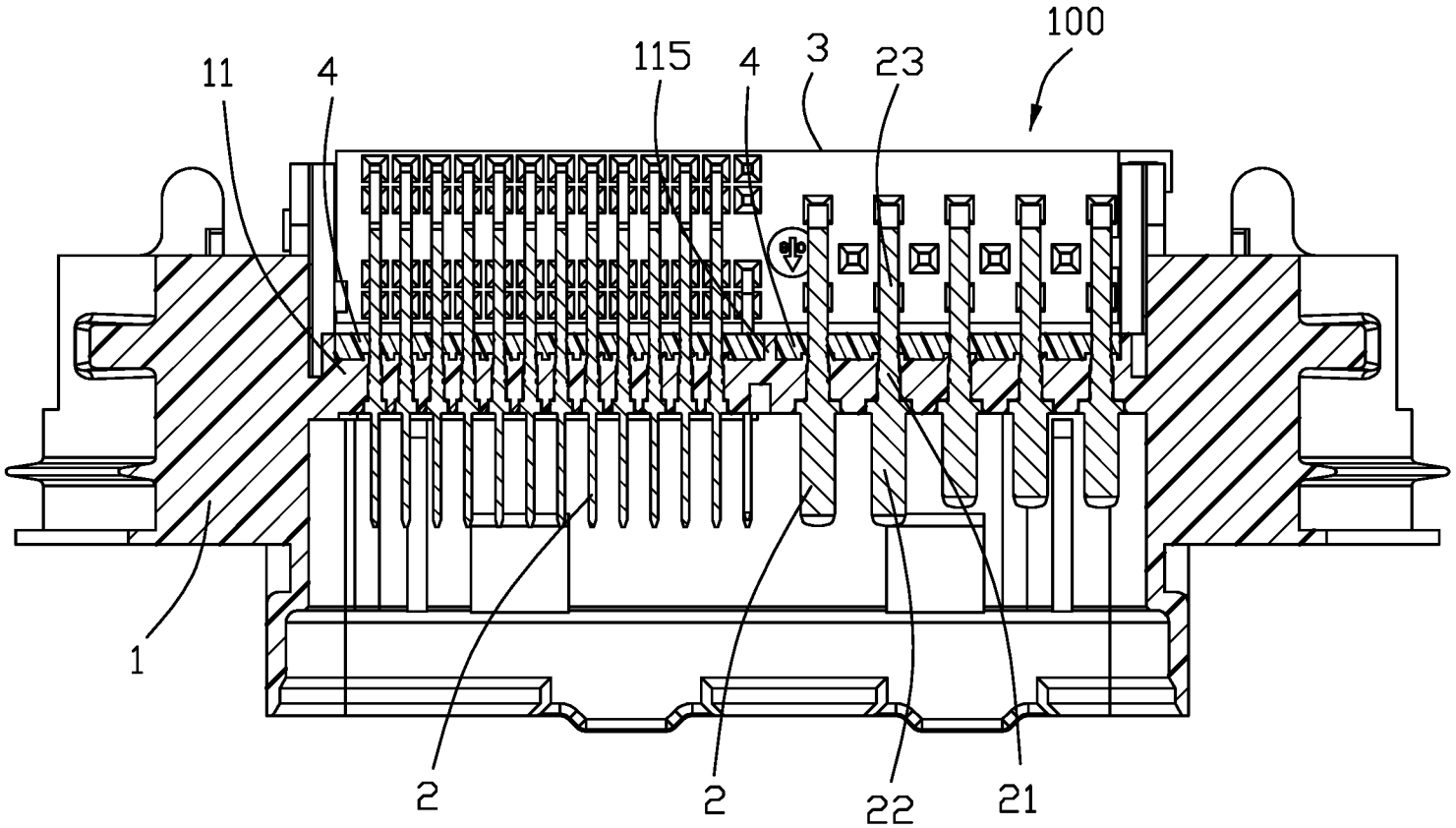
FIG. 10 is a cross-sectional view of the electrical connector of FIG. 8.

As shown in FIG. 9, the connecting section 23 forms a recess 231 in each side to enhance retention with the glue 4.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing including in a front-to-back direction a base, a pocket located in front of the base with a receiving cavity therein, and a receive space behind the base;

a plurality of passageways formed in the base and arranged with one another along a transverse direction, each passageway extending in the front-to-back direction;

a plurality of contacts assembled within the base, each contact including a retaining section retained in the base, a contacting section forwardly extending from the retaining section into the receiving cavity, and a mounting section located behind the retaining section and exposed outside of the housing with therebetween a connecting section located in the receiving space;

a plurality of partitions forms on a rear face of the base to form a plurality of glue rooms behind the corresponding passageways;

a plurality of tiny passages each formed in an exterior face of the partition shared by two neighboring glue rooms; and by having the rear face of the base upwardly exposed to an exterior, fluid type glue flows into the corresponding glue rooms and is distributed evenly by the passages to have the hardened glue have the same thickness attached upon the connecting sections of the contacts in the different glue rooms.

2. The electrical connector as claimed in claim 1, wherein each of said contacts includes a step structure around a front face of the base, and the corresponding passageway forms a recess to receive the step structure so as to allow the contact to be rearwardly inserted into the corresponding passageway from the front face of the base.

3. The electrical connector as claimed in claim 2, wherein a plurality of standoffs are formed on the rear face of the base around the corresponding passageways, respectively, to extend into the receiving space and be embedded within the hardened glue.

4. The electrical connector as claimed in claim 3, wherein the standoffs are respectively aligned with the corresponding step structures in the front-to-back direction while a width of the standoff is smaller than another width of the corresponding step structure in the transverse direction.

5. The electrical connector as claimed in claim 1, wherein the connecting section of each contact forms a recess to enhance engagement with the hardened glue.

6. The electrical connector as claimed in claim 1, wherein a space is assembled in the receiving space in a floating manner, through which the mounting sections of the contacts extend.

7. The electrical connector as claimed in claim 1, wherein the passage is located around a corner of the glue room.

8. A method of making an electrical waterproof connector, comprising steps of:

providing an insulative housing with a base having opposite front and rear faces thereon and a plurality of passageways extending therethrough in a front-to-back direction wherein each passageway forms a recess around the front face and a plurality of partitions are formed on the rear face to form the corresponding glue rooms wherein each partition forms a tiny passage in an exterior face toward an exterior;

providing a plurality of straight type contacts each with a step structure thereon;

rearwardly assembling the contacts into the corresponding passageways to have the step received within the corresponding recess; and rotating the housing to have the rear face of the base face upward;

applying fluid type glue into the corresponding glue rooms in an even manner via assistance of the corresponding passages; and rotating the housing back to a normal state wherein the passageways extend in the front-to-back direction.

* * * * *